United States Patent [19]

Jorgensen et al.

[11] 4,456,805

[45] Jun. 26, 1984

[54] PORTABLE TURNTABLE FOR USE IN MICROWAVE OVENS

[75] Inventors: Jorgen A. Jorgensen, Bloomington; Donald W. Nygren, St. Louis Park, both of Minn.

[73] Assignee: Northland Aluminum Products, Inc., Minneapolis, Minn.

[21] Appl. No.: 351,336

[22] Filed: Feb. 22, 1982

Related U.S. Application Data

[63] Continuation-in-part of Ser. No. 236,170, Feb. 20, 1981, which is a continuation of Ser. No. 927,928, Jul. 25, 1978, Pat. No. 4,258,630.

[51] Int. Cl.[3] ..... H05B 6/80

[52] U.S. Cl. ..... 219/10.55 F; 219/10.55 E; 99/443 R; 108/20; 108/139; 126/338; 185/39; 188/184

[58] Field of Search ..... 219/10.55 F, 10.55 E, 219/10.55 D, 10.55 R; 108/139, 142, 20; 99/423, 427, 443 R, 449; 126/338; 185/37, 38, 39, 10, 11; 188/184, 185

[56] References Cited

U.S. PATENT DOCUMENTS

| | | | |
|---|---|---|---|
| 3,627,085 | 12/1971 | Habuka | 185/37 X |
| 3,766,686 | 10/1973 | Sheckells | 188/185 X |
| 4,005,771 | 2/1977 | Cappotto et al. | 188/185 X |
| 4,216,727 | 8/1980 | Cunningham | 219/10.55 F |
| 4,330,696 | 5/1982 | Pomeroy et al. | 219/10.55 F |

*Primary Examiner*—Roy N. Envall, Jr.
*Assistant Examiner*—Philip H. Leung
*Attorney, Agent, or Firm*—Orrin M. Haugen; Thomas J. Nikolai; Douglas L. Tschida

[57] ABSTRACT

A portable turntable apparatus for use in microwave ovens which is used as a supporting base for a container of food which is cooked within the oven and adapted to gradually rotate the same, the apparatus including a motor including metallic materials which motor is mounted in and enclosed by a metal housing and an outer enclosure comprising a cover and base of non-metallic material to prohibit electrical arcing between the motor and the oven walls. The housing is provided with smooth outer surfaces and a minimal sized aperture opening to allow a driving connection between the motor and the enclosure cover. The motor is a spring motor having an improved centrifugal governor.

6 Claims, 8 Drawing Figures

PORTABLE TURNTABLE FOR USE IN MICROWAVE OVENS

CROSS REFERENCE TO RELATED APPLICATION

This application is a continuation-in-part of application Ser. No. 236,170, filed Feb. 20, 1981, which is a continuation of application Ser. No. 927,928, filed July 25, 1978, now issued as U.S. Pat. No. 4,258,630.

BACKGROUND OF THE INVENTION

It has long been recognized that the heating of food within an oven enclosure will be more uniform throughout the food product if it is rotated during the heating process. This is particularly desirable where the product is baked such as cakes, breads or the like.

Early recognition of this concept is found in U.S. Pat. No. 416,839 to Howard and U.S. Pat. No. 557,344 to Shaw.

With the advent of microwave cooking the principle involved became even more important due to the rapidity of baking or cooking the finished product. Accordingly, others have invented structures specifically designed for microwave ovens. Examples are U.S. Pat. Nos. 2,632,838 to Schroeder and 3,177,335 to Fitzmayer et al., both of which show the use of turntables within an oven utilizing ultra-high frequency electromagnetic wave energy (hereinafter referred to as "microwave") for cooking the product within the oven.

In microwave cooking the inner and outer portions of the product within the oven are both heated simultaneously and quickly to a normal cooking temperature. However, the microwave energies are not uniformly distributed within the oven enclosure resulting in unevenness in cooking throughout the body of the food product. It is accordingly even more desirable that the food product be slowly rotated during baking within a microwave oven. As the product is rotated the food passes through uneven microwave patterns to create an even cooking effect eliminating any so-called "hot spots" in the product mass.

While the latter two of the aforementioned patents do disclose turntable mechanisms for rotating a food product container during the cooking process in a microwave oven, they are built into the oven itself thus allowing the driving motor to be disposed outside of the oven interior. These structures are accordingly expensive and are not adapted for use with ovens not so equipped by the original manufacturer.

It is accordingly desirable that a turntable construction be provided in the way of a portable accessory that can be used only when necessary or desirable within a microwave oven.

SUMMARY OF THE INVENTION

A primary object of the present invention is to provide a self-enclosed and motorized turntable which may be energized and placed within an oven to serve as a base for a container of a food product cooked therein and gradually rotate the container during the cooking process.

Another object of the invention is to provide a portable rotary stand or turntable which may be used in microwave ovens with no arcing between the turntable drive mechanism and the oven.

Still another object of the invention is to provide a portable rotary turntable for use in microwave ovens which is durable, economical to manufacture, and relatively easy to operate, keep clean and store.

Yet another object of the invention is to provide a portable rotary turntable for use in microwave ovens which is powered by a spring motor with an improved centrifugal governor employing a disc with a tab or tabs.

With these and other objects in view the invention broadly comprises a rotary turntable having a pan shaped base with an annular side wall, a cover member, of similar diameter and positioned in covering relation over the pan, a motor housing of metallic material disposed within and secured to the pan, a spring motor with an improved governor mounted within the housing, means for energizing the motor, drive means acting between the motor and cover whereby as the motor is energized the cover will be rotated relative to the base.

BRIEF DESCRIPTION OF THE DRAWINGS

The accompanying drawings illustrate a complete embodiment of the invention, together with alternatives thereto, according to the best mode so far devised for the practical application of the principles thereof, and in which.

DESCRIPTION OF THE PREFERRED EMBODIMENT

Figure 1:
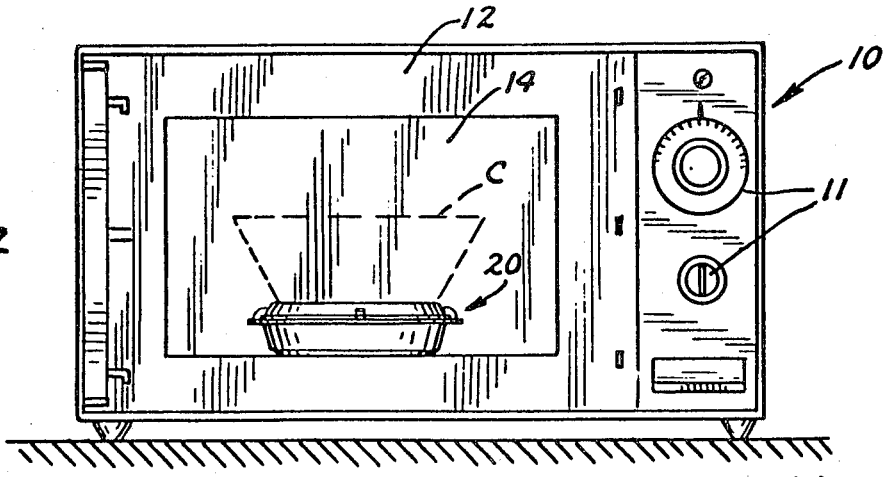
FIG. 1 is a front elevation of a conventional microwave oven with a transparent window in the front door showing the portable turntable positioned on the bottom or bottom shelf of the oven supporting a container for a food product being cooked in the oven.
Figure 2:
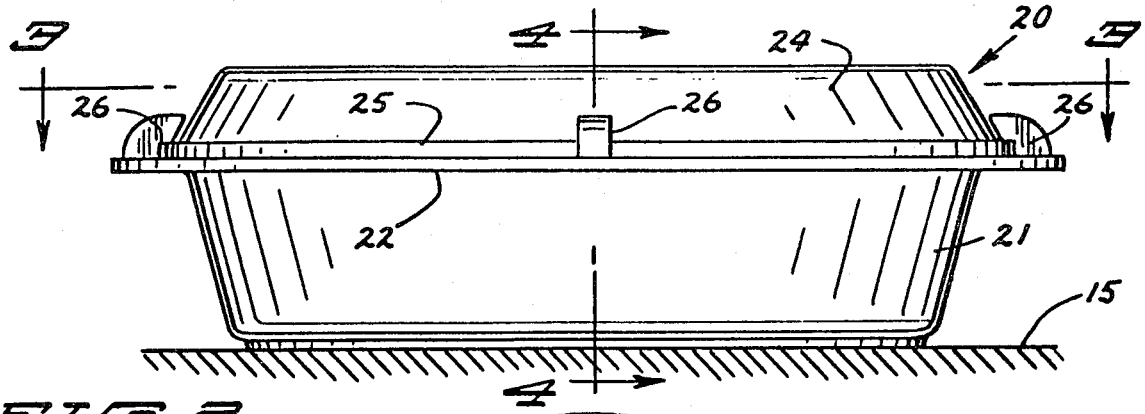
FIG. 2 is an enlarged side elevation of the turntable unit.

Referring now more particularly to the drawings reference numerals will be used to denote like parts or structural features in the different views. The numeral 10 denotes generally a conventional microwave oven of boxlike configuration with controls 11, and hinged front door 12 having a transparent window 14 mounted therein. The bottom of the oven upon which the turntable unit rests is shown at 15 in FIG. 2 and a container C is shown positioned on the turntable within the oven in FIG. 1.

The turntable unit itself forming the subject of the present invention is designated generally by the numeral 20. It has a vertically shallow cylindrical overall shape and the construction thereof will best be understood by reference to FIG. 4.

A bottom turntable base 21 is pan shaped with a flat bottom adapted to rest upon the oven bottom 15 and having an annular side wall which terminates in an outwardly extending flange 22 around the upper edge. Flange 22 has apertures 23 spaced therearound.

Base 21 is formed of a material which is transparent to microwaves, having a low dielectric constant and having a low dissipation factor. This material will hereafter be referred to merely as "dielectric material."

A rotatable turntable cover 24, also of said dielectric material, is horizontally circular and adapted to mate with and cover base 21. Cover 24 has a terminal annular flange 25 which has the same diameter as the inner portion of flange 22. Clips 26 circumferentially spaced about the turntable each have a pair of resilient prongs 27 adapted to slip through an aperture 23 to interlock with flange 22. Each clip 26 also has a projection 28 extending inwardly over the cover flange 25 to loosely retain the cover 24 against upward removal from the base 21.

A motor housing 29 of metal material is disposed within the turntable enclosure between the base 21 and cover 24. This housing has an upwardly opening circular pan 30 with apertures, no larger than 12 millimeters in diameter, in the bottom thereof which are in fixed engagement with projections 31 integrally formed on the bottom of turntable base 21. The motor housing 29 also includes a cover 32 which completely covers the top of pan 30 with a turnover flange providing a secure interlock 34 between the cover and pan. It is particularly important that the exposed edges on the interlock 34 be as smooth or rounded as possible. The minimization of any sharp edges on the exterior surface of the motor housing 29 is very important. However, it will be understood that the members 30 and 32 jointly form a rigid exteriorly smooth housing for the motor housed therewithin.

Cover 24 is provided with an annular upwardly opening raceway 35 which is concentric with the center of the cover. Raceway 35 carries a plurality of ball bearings 40 which may freely roll therein. The underside of cover 24 has an annular raceway 41 molded therein which opens downwardly in vertically opposing relation to raceway 35 in topwise engagement with the bearings 40. Bearings 40 are preferably formed of glass or other dielectric material and are disposed between the raceways 35 and 41.

The diameter of bearings 40 is sufficient to support cover 24 above the turntable base 21 in a slightly elevated position with respect to base 21 so that the flange 25 is spaced slightly above flange 22 yet connected loosely thereto by clips 26.

The numeral 38 denotes an annular roller case plate of dielectric material which has a series of apertures 39 spaced therearound for loosely receiving the ball bearings 40 and retaining them in spaced relation. It has been found, however, that in practice of the invention the retainer 38 may be provided with a near continuous groove. In a still further alternative the plate 38 may be eliminated entirely, with a loosely spaced but continuous series of bearings 40 supporting the cover 24.

A stub shaft 42 is integrally formed with and on the underside of cover 24 at the center thereof. The lower portion of shaft 42 may be, for reasons of durability, formed or lined with metal material which must be spaced at least 3 millimeters from the cover. In the disclosed embodiment of the invention shaft 42 has a squared internal socket 44 formed therein.

A generally U-shaped mounting bracket 45 is secured to the underside of the pan cover 32 as by rivets 46. The purpose of bracket 45 is to mount the motor, designated generally by the numeral 50, within the motor housing 29. Bracket 45 has pairs of opposing arms 51 depending from each end thereof to jointly support a motor mount having a center bar or plate 52 connected to arms 51, and upper and lower elongated plates, denoted respectively at 54 and 55, and suitably connected at their ends to the center plate 52. Plates 52, 54 and 55 lie on parallel planes.

The motor here shown is of the wind-up type. A square shaft 56 extends through and is journaled in the members 45, 52, 54 and 55 and is held against upward displacement by a cross pin 57 in its lower end. Shaft 56 carries a main gear 58 held in place by spacers 59 between the members 52 and 54. A coil spring 60 has its inner end connected to the shaft 56 and its outer end 61 suitably retained in a slot in the leg supporting one end of plate 55. The upper end of shaft 56 fits within the opening 44 in the stub shaft 42 whereby when the cover 24 is turned in a clockwise direction, as viewed from the top, the spring 60 will be wound.

Figure 3:
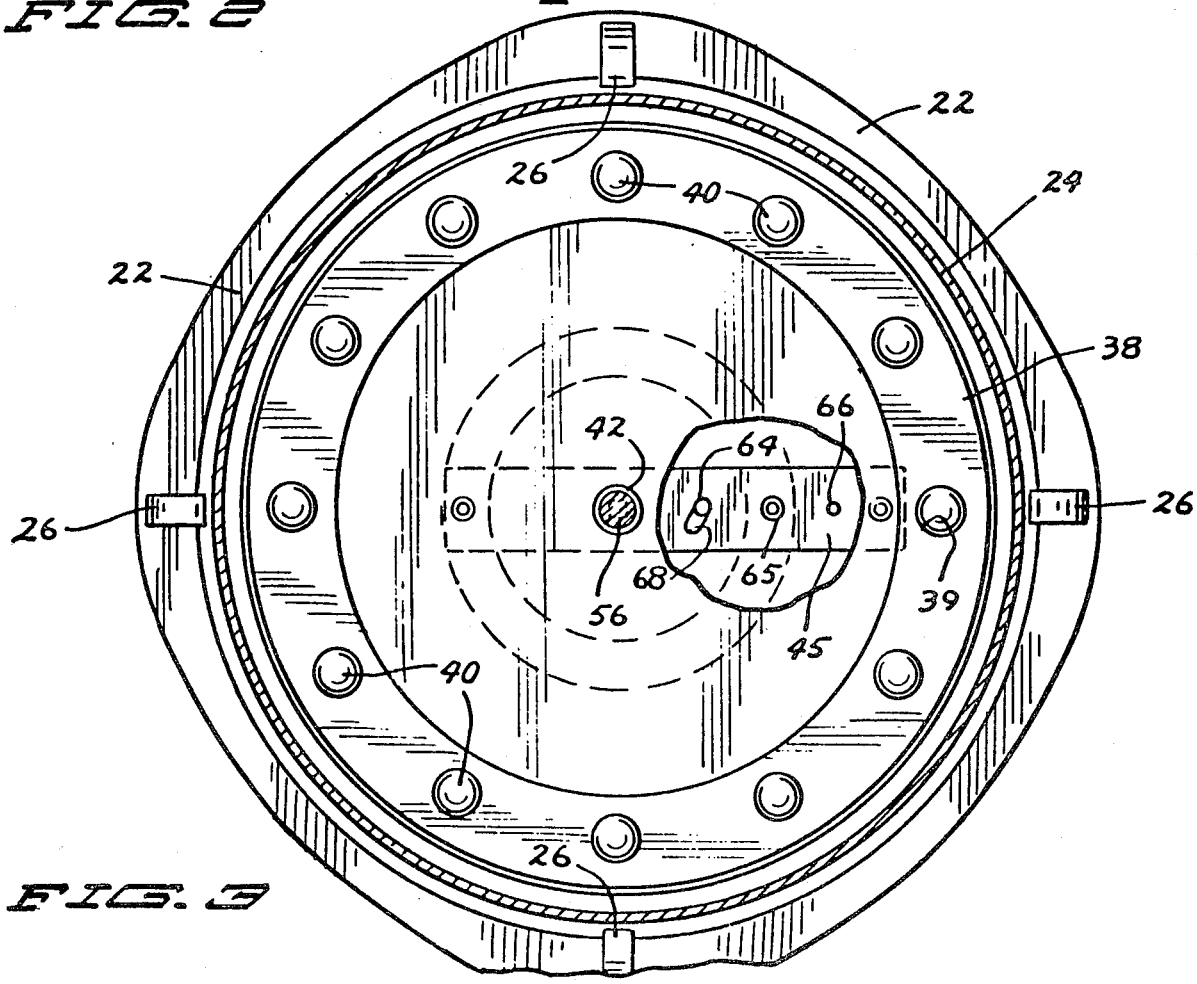
FIG. 3 is a horizontal section through the upper portion of the unit taken on line 3—3 of FIG. 2.

Also within motor 50 there is a braking or timing gear mechanism to restrict the speed of rotation imparted by the spring 60 to the output shaft 56. This mechanism includes a series of spaced parallel upright shafts 64, 65 and 66 having their ends journaled in the plates 52 and 54. Shaft 64 is mounted in slots 68 (FIG. 3) which are generally tangential with respect to the axis of shaft 56 allowing movement of the shaft between idler and operative positions.

Figure 4:
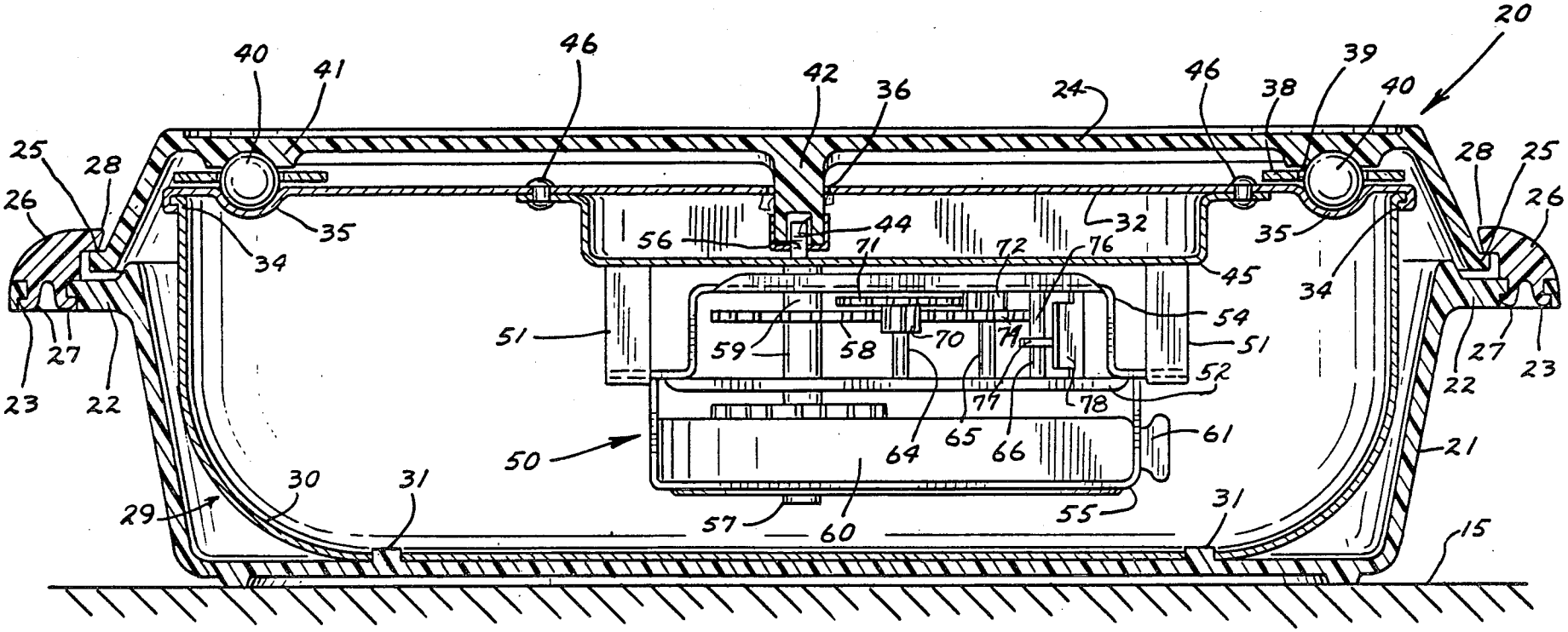
FIG. 4 is a vertical section through the turntable unit taken on line 4—4 of FIG. 2 but showing portions of the motor in elevation.

While shaft 56 is being wound the shaft 64 will slide forwardly, as viewed in FIG. 4, in the slot 68. Shaft 64 carries a pinion gear 70, which meshes with main gear 58, and much larger gear 71 at its upper end. Shaft 65 carries a pinion gear 72, which meshes with gear 71, and also carries a larger gear 74. The upper portion of shaft 66 has peripheral gear segments at 76 which mesh with gear 74. In the first alternative shown in FIGS. 3 and 4 the shaft 66 also has a star gear 77 fixed thereto which engages central portions of a braking member 78 vertically journaled in the plates 52 and 54 for limited oscillating movement.

Figure 5:
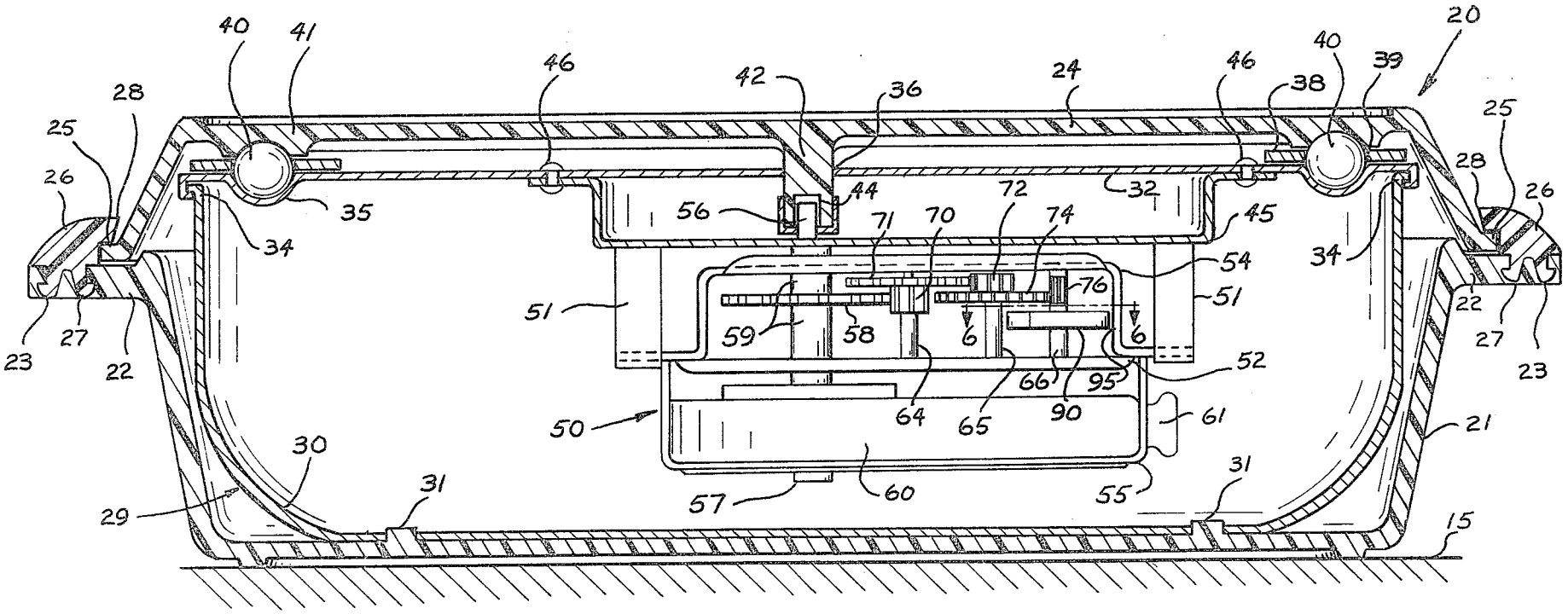
FIG. 5 is a vertical section through the turntable unit taken on line 4—4 of FIG. 2 showing portions of the motor in elevation and illustrating the improved governor structure.
Figure 6:
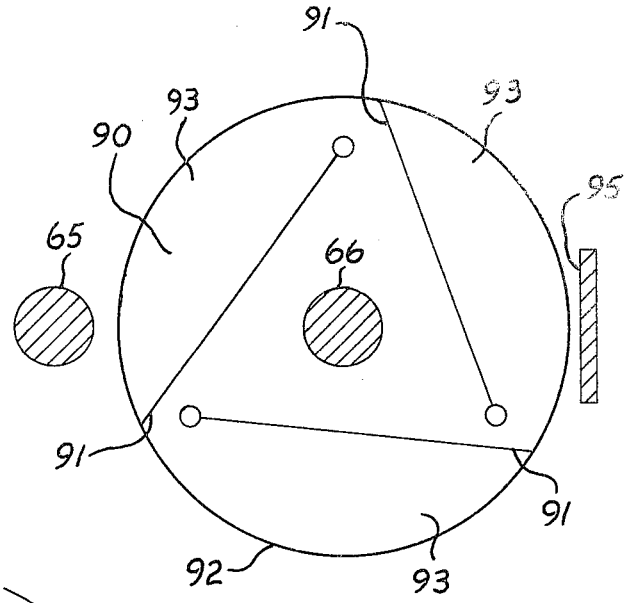
FIG. 6 is a top view taken on line 6—6 of FIG. 5 showing the governor structure.
Figure 7:
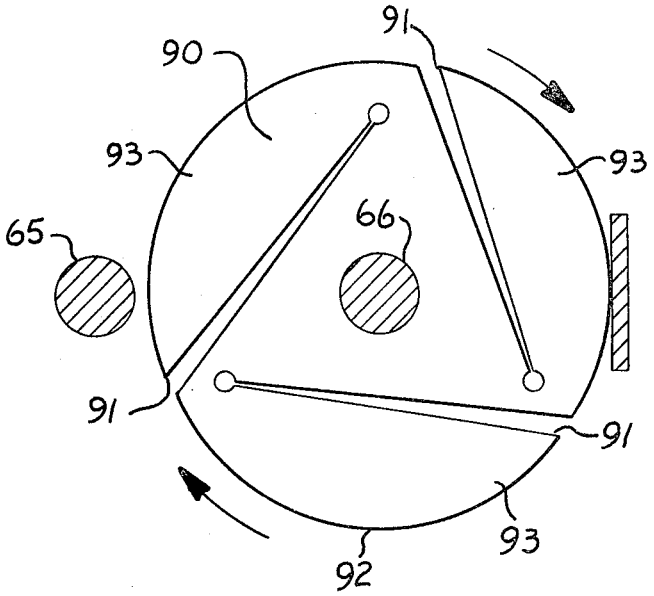
FIG. 7 is a top view taken on line 6—6 of FIG. 5 showing the governor in operation.

A second alternative speed control for the spring motor is shown in FIGS. 5–7. The shaft 66 in this alternative has no star gear 77 nor braking member 78 but instead has a disc 90 mounted axially on shaft 66.

Disc 90 has one or more resilient tabs 93 about its periphery. In the preferred embodiment shown in FIGS. 5–7, the tabs 93 are integral with disc 90 being defined by slits 91 about the periphery of disc 90 which slits 91 extend inwardly at an angle from the peripheral edge 92 of disc 90 along a chord to a point within the disc 90 but does not extend completely across disc 90, all as shown in FIG. 6.

The tabs 93 thus formed are continuous with the remainder of the disc 90 but have some freedom of movement with respect to the remainder of the disc 90 due to the resilient nature of the disc 90, and said tabs 93 may be displaced from the rest position shown in FIG. 6 by application of centrifugal force the positions shown in FIG. 7.

Figure 8:
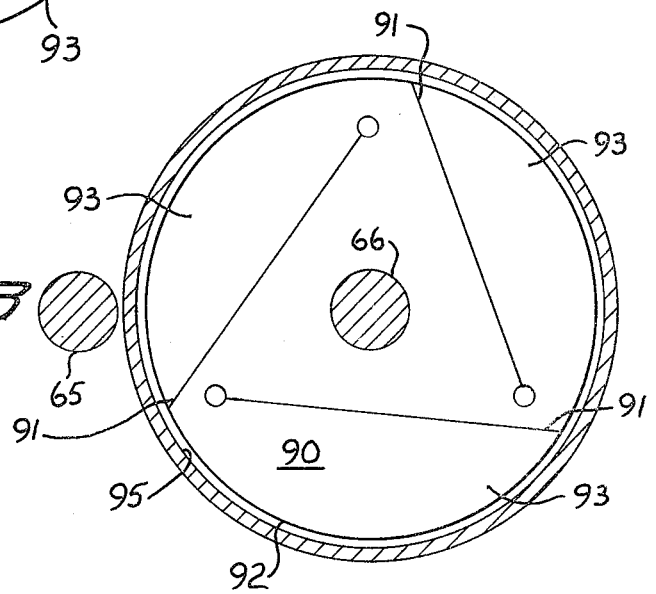
FIG. 8 is a view similar to that of FIG. 6 showing a cylindrical brake element.

Adjacent to the edge 92 or periphery of disc 90 is a fixed brake element 95, shown in FIGS. 5–7 as a vertically extending strip of metal, but may also be in the form of a cylinder encircling disc 90 like a brake drum as is shown in FIG. 8.

Disc 90 has very low abrasion properties but sufficient friction property to slow disc 90 and hence motor 50 to a fixed speed when the tab members 93 brush against the stationary element 95. Preferred materials for disc 90 are the group of silicone, polyurethane, plastic and rubber having the desired friction, abrasion and resilience. Disc 90 acts as a governor embodying weights, pivots and spring to provide centripetal restraining force all in a single piece. The result is an extremely efficient, compact and economical to manufacture governor structure. It provides constant speed control in a small reliable structure.

When the shaft 56 is being wound the shaft 64 will also be wound while in its forward or idler position, the other portions of the mechanism remaining motionless. When holding pressure is removed from shaft 56, the gear 58 through engagement with gear 70 will move shaft 64 to its rear or operative position. This places gear 71 in engagement with pinion 72.

In the first alternative speed control mechanism shown in FIG. 4, as the unwinding force of spring 60 is exerted upon the shaft 56, such force will be transmitted through the gears 58, 70, 71, 72, 74, 76, and 77 to the member 78. The limited oscillating movement of member 78 and the speed reduction of the gear mechanism will allow shaft 56 to revolve at a very slow speed. The motor mechanism involved is well known in the art.

In the second alternative speed control mechanism shown in FIGS. 5–7, the unwinding force of spring 60 is exerted upon shaft 56, such force being transmitted by means of the gear train through gears 58, 70, 71, 72, 74 and 76 to shaft 66. Disc 90 is mounted on shaft 66 and receives the force causing it to rotate with shaft 66. As disc 90 rotates, tabs 93 are pulled by centrifugal force outwardly from the center of disc 90.

Due to the gearing between shaft 56 and shaft 66, shaft 66 rotates much more rapidly than shaft 56 or, conversely, the output shaft 56 rotates more slowly. As the rotational velocity of shaft 66 and disc 90 increases, tabs 93, and particularly the outer ends of tabs 93, are pulled further outwardly until they encounter brake element 95 as shown in FIG. 7. At this point, tabs 93 wipe across brake element 95. The drag or friction produced between tab 93 and brake element 95 acts to slow or retard the velocity of rotation of disc 90, which serves to govern the rotation at a fairly constant limiting velocity. For purposes of illustration, three tabs 93 are shown, but one single tab 93 would also serve the same function.

The motor used in the assembly may also be battery operated utilizing a suitable gear assembly from the battery operated motor to the shaft 56. Still another alternative is to use suitable motor means within a housing 29 to drive or rotate the cover 21 through a driving connection with the rim or flange portion 25 of the cover, rather than the center stub shaft 42.

In the embodiment herein shown and described, it will be understood that, prior to use, the cover 24 will be manually rotated to wind the spring 60. The turntable is then inserted into the oven onto the oven bottom 15 and the container C is placed upon the cover member 24. The slow unwinding bias of the spring 60 will cause a very slow rotation of the container C and the food product contained therein during the cooking or baking process.

The center aperture 36 in the pan cover 32 should closely receive shaft 42 while yet permitting rotation of the shaft therein. It has been found that for maximum performance the diameter of the aperture 36 should be twelve millimeters or less, allowing reception of a stub shaft 42 of sufficient strength to support the cover while eliminating microwave energy from entering the motor housing 29. The same dimensions are critical where rechargeable batteries might be used to drive the motor, requiring both rechargeable connection and switch openings in the housing 29.

The invention accordingly economically and effectively carries out the aforementioned objectives.

Having now therefore fully illustrated and described our invention, what we claim to be new and desire to protect by U.S. Letters Patent is:

1. In a portable turntable for use in microwave ovens to rotate a container containing a food product cooked within the oven, (a) a pan shaped base having a flat bottom and an upright peripheral side wall, (b) a cover disposed in covering position over the base rotably mounted to the base, (c) a metal housing fixedly connected to the base, (d) a wind-up spring motor having an output shaft enclosed within the housing and having a driving connection with the cover to rotate said cover, said base, cover and driving connection being formed of a dielectric material, (e) a centrifugal governor, (f) a gear train connecting the output shaft and the centrifugal governor so that the output shaft rotates more slowly than the centrifugal governor, (g) said metal housing being relatively smooth and unencumbered with sharp edges throughout its entire exterior surface, and (h) an aperture in said metal housing of a size to receive said driving connection therethrough but sufficiently small to effectively eliminate microwave energy from the interior of said housing.

2. The portable turntable of claim 1 wherein the centrifugal governor further comprises a shaft, a disc mounted axially on the shaft, a resilient tab attached to the periphery of the disc and a brake element adjacent the periphery of the disc so that when the disc is rotated the tab will move outwardly contacting the brake element to retard the rotation to a fairly constant velocity.

3. The portable turntable of claim 2 wherein the disc and tab are formed of a single resilient piece, the tab being separated by a slit from the remainder of the disc.

4. In a portable turntable for use in microwave ovens to rotate a container containing a food product cooked within the oven, (a) a pan shaped base having a flat bottom and an upright annular peripheral side wall, (b) a circular cover disposed in covering position over the base and having a peripheral downwardly depending rim adapted to mate with the pan side wall to form an enclosure, (c) said base and cover both being formed of a certain material transparent to microwave having a low dielectric constant and having a low dissipation factor, (d) a metal housing secured to the base, said housing having its external surface free of sharp edges with the exception of an aperture of a predetermined size which is a fraction of the wavelength of the microwave energy employed, (e) a wind-up spring motor mounted within the housing, said motor having an output shaft, (f) a centrifugal governor, (g) a gear train connecting the output shaft and the centrifugal governor so that the output shaft rotates more slowly than the centrifugal governor, (h) means for energizing the motor; and (i) drive means having the qualities of said certain material connecting the motor to the cover through the housing aperture to rotate the cover on the base about its center axis so that a container resting upon the cover will rotate with the cover.

5. The portable turntable of claim 4 wherein the centrifugal governor further comprises a shaft, a disc mounted axially on the shaft, a resilient tab attached to the periphery of the disc and a brake element adjacent the periphery of the disc so that when the disc is rotated the tab will move outwardly contacting the brake element to retard the rotation to a fairly constant velocity.

6. The portable turntable of claim 5 wherein the disc and tab are formed of a single resilient piece, the tab being separated by a slit from the remainder of the disc.

* * * * *